US007555808B2

(12) United States Patent
Oh et al.

(10) Patent No.: US 7,555,808 B2
(45) **Date of Patent: *Jul. 7, 2009**

(54) VACUUM CLEANER HAVING A CYCLONE DUST COLLECTING APPARATUS

(75) Inventors: Jang-Keun Oh, Gwangju (KR); Ki-Man Kim, Gwangju (KR); Kyong-Hui Jeon, Chungcheongnam-do (KR); Jung-Gyun Han, Busan (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 689 days.

This patent is subject to a terminal disclaimer.

(21) Appl. No.: 11/212,213

(22) Filed: Aug. 26, 2005

(65) Prior Publication Data

US 2006/0101610 A1 May 18, 2006

(30) Foreign Application Priority Data

Nov. 16, 2004 (KR) ..... 10-2004-0093413
Apr. 13, 2005 (KR) ..... 10-2005-0030609

(51) Int. Cl.
*A47L 9/16* (2006.01)
*A47L 9/32* (2006.01)

(52) U.S. Cl. ..... 15/327.2; 15/327.7; 15/410

(58) Field of Classification Search ..... 15/327.2, 15/372.7, 412, 326, 410
See application file for complete search history.

(56) References Cited

FOREIGN PATENT DOCUMENTS

| | | |
|---|---|---|
| GB | 2399780 | 9/2004 |
| JP | 2002-282178 | 10/2002 |
| JP | 2003180569 | 7/2003 |
| KR | 1019960005455 | 4/1996 |
| KR | 20030038415 | 5/2003 |
| WO | WO03068041 | 8/2003 |

OTHER PUBLICATIONS

British Combined Search and Examination Report dated Nov. 10, 2005 in connection with corresponding British Application No. 0518870.1.

*Primary Examiner*—Randall Chin
(74) *Attorney, Agent, or Firm*—Ohlandt, Greeley, Ruggiero & Perle, L.L.P.

(57) ABSTRACT

A vacuum cleaner is provided that includes a cleaner body; a cyclone body rotatably mounted in the cleaner body; a dust receptacle detachably mounted in the cleaner body and disposed below the cyclone body; and a locking unit locking and releasing the cyclone body and the dust receptacle with respect to each other.

9 Claims, 4 Drawing Sheets

VACUUM CLEANER HAVING A CYCLONE DUST COLLECTING APPARATUS

CROSS-REFERENCE TO RELATED APPLICATIONS

This application claims benefit under 35 U.S.C. § 119(a) of Korean Patent Applications No. 2004-93413 filed Nov. 16, 2004 and No. 2005-30609 filed Apr. 13, 2005, the entire contents of both of which are incorporated herein by reference.

BACKGROUND OF THE INVENTION

1. Field of the Invention

The present invention relates to a vacuum cleaner having a cyclone dust collecting apparatus.

2. Description of the Related Art

Generally, a cyclone dust collecting apparatus, which separates and collects dust from dust-laden air using a centrifugal force, comprises a cyclone body in which the dust is separated from the dust-laden air by a centrifugal force and a dust receptacle connected to the cyclone body to collect therein the separated dust.

As disclosed in Japanese Patent Laid-open No. 2003-180569 and Korean Patent Laid-open No. 2003-0038415, such a cyclone dust collecting apparatus is detachably mounted to a cleaner body of the vacuum cleaner so that the dust receptacle can be emptied after collecting the dust therein. Therefore, a user first has to draw the dust collecting apparatus from the vacuum cleaner and then detach the cyclone body from the dust receptacle to empty the dust receptacle.

However, the above duplicate separation system, that is, drawing first the dust collecting apparatus from the vacuum cleaner and separating next the cyclone body from the dust receptacle, may be troublesome for the user. Furthermore, since the user has to apply a certain force to separate the cyclone body from the dust receptacle, the dust can be bounced out by the force during the separation and contaminate the user's hand.

Meanwhile, in the vacuum cleaner having the cyclone dust collecting apparatus, the cleaner body needs to be equipped with a suction pipe for fluidly communicating the cyclone dust collecting apparatus with an extension pipe and a connection pipe for fluidly communicating the cyclone dust collecting apparatus with a vacuum source. However, since the suction pipe and the connection pipe occupy a large space in the cleaner body, the cleaner body is hard to be configured in a variety of forms. Such a problem proves more considerable especially in a canister-type vacuum cleaner, which has a small body.

SUMMARY OF THE INVENTION

An aspect of the present invention is to solve at least the above problems and/or disadvantages and to provide at least the advantages described below. Accordingly, an aspect of the present invention is to provide a vacuum cleaner in which only a dust receptacle, instead of the whole of a cyclone dust collecting apparatus, is separated to remove collected dust.

Another aspect of the present invention is to provide a vacuum cleaner having a cyclone dust collecting apparatus, capable of being structured in various configurations.

In order to achieve the above-described aspects of the present invention, there is provided a vacuum cleaner comprising a cleaner body; a cyclone body rotatably mounted in the cleaner body; a dust receptacle detachably mounted in the cleaner body and disposed below the cyclone body; and a locking unit locking and releasing the cyclone body and the dust receptacle with respect to each other.

The vacuum cleaner further comprises a cover rotatably mounted to the cleaner body. The dust separator is connected to the cover.

The locking unit comprises a button formed on a handle of the dust receptacle and having a hook; a fastening part provided to the dust separator to lock and release the hook; and a first resilient member pressing the button in a direction for locking the hook.

The fastening part comprises a supporting projection protruded on the dust separator; and a hook holder formed on a lower part of the supporting projection.

The cleaner body comprises a suction pipe through which the air flows into the cyclone body; and a connection pipe through which the air flows out from the cyclone body. The suction pipe and the connection pipe are mounted within the cleaner body.

The suction pipe is extended from a front to a rear along an inner bottom of the cleaner body and bent upward by a predetermined angle to be connected with the cyclone body.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE EXEMPLARY EMBODIMENTS

Figure 1:
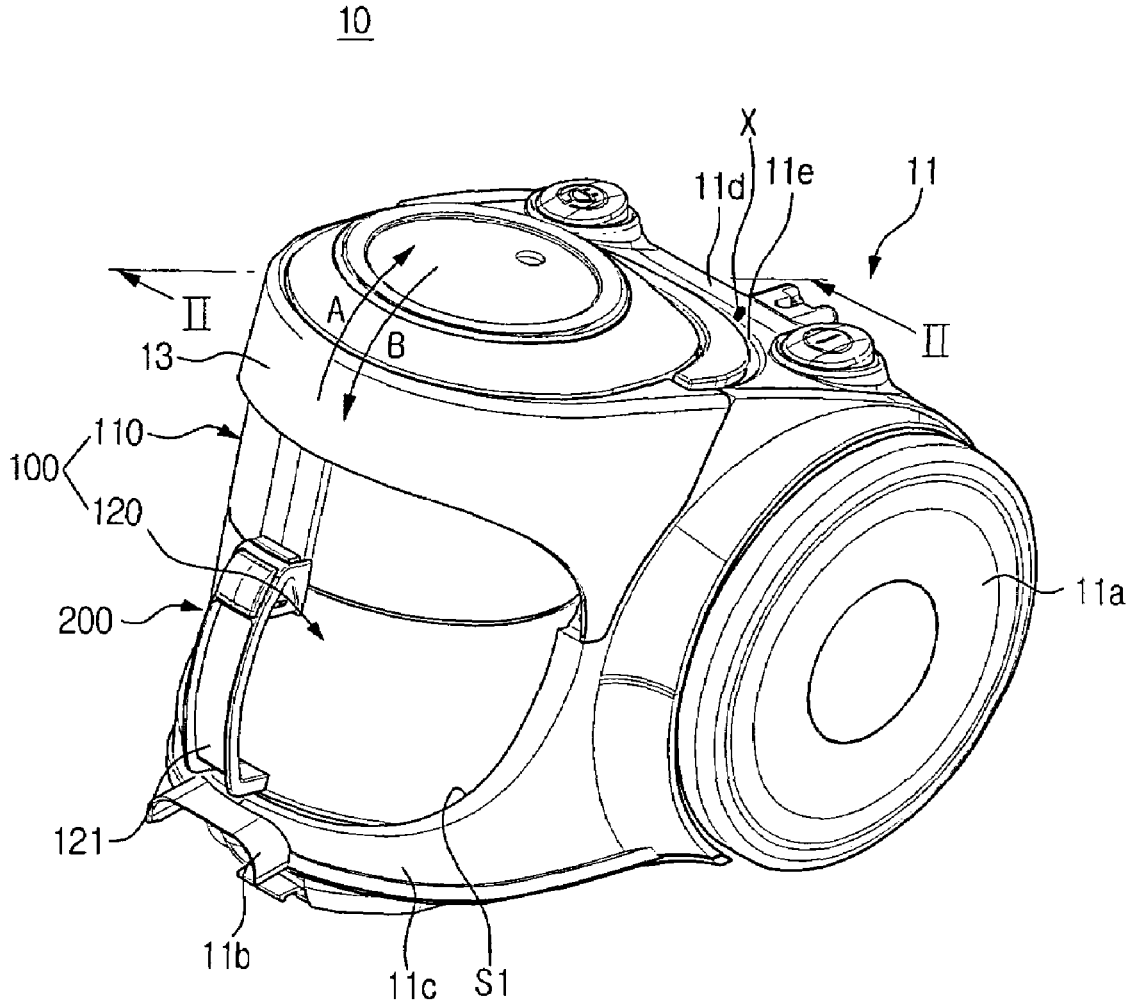
FIG. 1 is a perspective view of a vacuum cleaner having a cyclone dust collecting apparatus according to an embodiment of the present invention.

Hereinafter, an embodiment of the present invention will be described in detail with reference to the accompanying drawing figures.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Referring to FIG. 1, a vacuum cleaner 10 according to an embodiment of the present invention is illustrated. Vacuum cleaner 10 comprises a cleaner body 11, a cover 13, a cyclone dust collecting apparatus 100, and a locking unit 200.

The cleaner body 11 includes rotatable wheels 11*a* and a dust collecting chamber S1 for mounting of the dust receptacle 120. By mounting the dust receptacle 120 in the dust collecting chamber S1, a lower part of the dust receptacle 120 is enclosed by a sidewall 11*c* that constitutes the dust collecting chamber S1 so that the dust receptacle 120 can not be moved.

Figure 2:
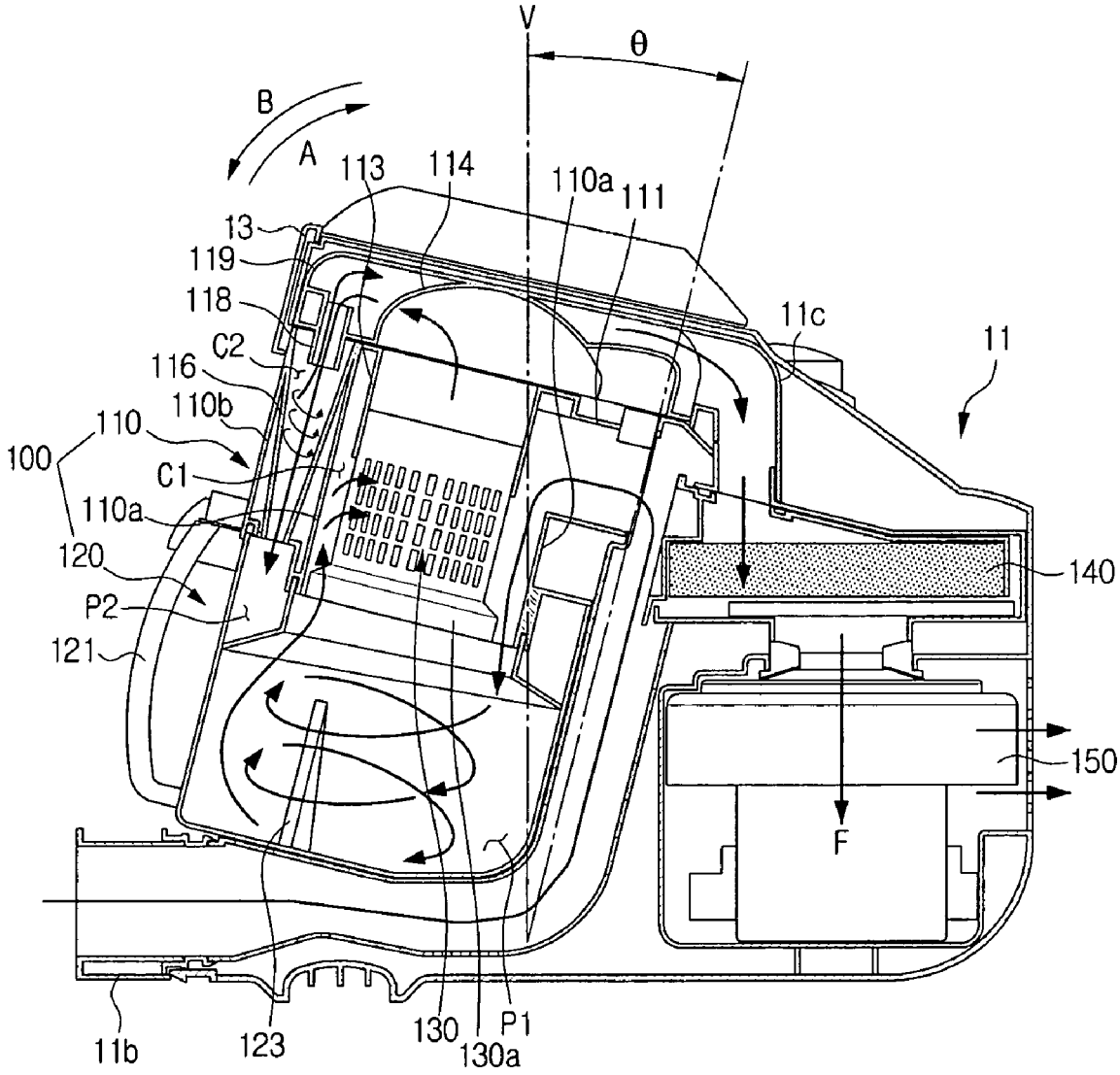
FIG. 2 is a sectional view of FIG. 1 cut along a line II-II.

The cleaner body 11 includes a suction pipe 11*b* connected to an extension pipe (not shown) so that an external air can be drawn into a cyclone body 110 through the suction pipe 11*b*. For this purpose, the suction pipe 11*b* is extended from a front to a rear along an inner bottom of the cleaner body 11 and bent by a predetermined angle to be connected with an air suction path 111 of the cyclone body 110, as shown in FIG. 2. In this embodiment, for example, the suction pipe 11*b* is bent upwardly by approximately 15° (degrees) with respect to a vertical line V.

Thus, being not exposed to the outside, the suction pipe 11*b* formed on the inner bottom of the cleaner body 11 can enhance durability thereof. In addition, since the suction pipe 11*b* does not occupy much space in the cleaner body 11, various structures and designs of the cleaner body 11 can be implemented.

The cover 13 is rotatably mounted to the cleaner body 11. For this, the cover 13 is hinged on a hinge shaft X of the cleaner body 11 to pivot on the hinge shaft X by a predetermined angle in arrowed directions A and B.

The cyclone dust collecting apparatus 100 separates and collects dust included in external air, which is drawn in through the suction pipe 11*b*. Therefore, the cyclone dust collecting apparatus 100 mainly comprises the cyclone body 110 and the dust receptacle 120.

Referring to FIG. 2, the cyclone body 110 comprises a first cyclone C1 and a second cyclone C2. Here, an arrow F in the drawing denotes flow of the air into the vacuum source 150.

The first cyclone C1 is formed in the center of the cyclone body 110 by being surrounded by inner wall 110*a* of the cyclone body 110 and herein, primary separation of the dust is carried out. The first cyclone C1 comprises the air suction path 111, an air discharge path 113, a grill member 130, and an induction cover 114.

The air suction path 111 is formed as a substantially cylindrical pipe of which one end is mounted on the inner wall 110*a* to be connected with the inside of the first cyclone C1 while the other end is connected to the suction pipe 11*b*. Through the air suction path 111, the air drawn in through the suction pipe 11*b* can flow into the first cyclone C1.

The air discharge path 113 is formed as a substantially cylindrical pipe and disposed in the center of the first cyclone C1. Through the air discharge path 113, the air primarily centrifuged in the first cyclone C1 flows out to the second cyclone C2.

The grill member 130 is implemented by a filter disposed on a circumference of the air discharge path 113. The grill member 130 secondarily filters the dust included in the air being discharged through the air discharge path 113. In order to prevent backflow of the dust, a skirt 130*a* is formed at a lower portion of the grill member 130.

The induction cover 114 guides the air passed through the air discharge path 113 into the second cyclone C2 by closing a top portion of the air discharge path 113.

The second cyclone C2 is a space surrounded by the inner wall 110*a* and an outer wall 110*b*. A plurality of the second cyclones C2 (only one shown) are formed around the first cyclone C1 in order to secondarily filter the dust which has not yet separated by the first cyclone C1. Each of the second cyclones C2 comprise a cone member 116 and a discharge pipe 118.

The cone member 116 is disposed in the center of each second cyclone C2. The dust included in the air that has passed through the first cyclone C1 is further separated by a centrifugal force in the cone member 116 of the second cyclones C2. More specifically, the air swirls downward from a top of the cone members 116 and bounces upward from a bottom of the cone members 116. The remaining dust is separated by repeating the above process. The dust separated by the second cyclones C2 is collected in a second dust collecting chamber P2.

The discharge pipe 118 is formed as a substantially cylindrical pipe and inserted in the center portion of the cone member 116 by a predetermined length. The air further separated by the cone member 116 flows out through the discharge pipe 118.

A discharge cover 119 is connected to the connection pipe 11*c* by one end to close top portions of the discharge pipe 118 and the induction cover 114. By existence of the discharge cover 119, the air passed through the discharge pipe 118 is converged and guided into the connection pipe 11*c*.

The connection pipe 11*c* brings the cyclone body 110 and the vacuum source 150 into fluid communication with each other, so that the air in the cyclone body 110 can be discharged through the connection pipe 11*c*. A filter 140 is mounted between the connection pipe 11*c* and the vacuum source 150. Because the connection pipe 11*c* is formed inside the cleaner body 11, in other words, not exposed to the outside, durability of the connection pipe 11*c* can be enhanced. In addition, the connection pipe 11*c* does not have to occupy much of inner space of the cleaner body 11, thereby enabling a variety of structures and designs of the cleaner body 11.

Preferably, the cyclone body 110 is detachably mounted to the cover 13 for more facile maintenance and management. When the cyclone body 110 is separated from the dust receptacle 120, the cyclone body 110 is able to rotate about the hinge shaft X in the arrowed directions A and B together with the cover 13. Herein, since a bottom of the dust collecting chamber S1 is sloped down to backward of the cleaner body 11 by approximately 15° with respect to a vertical line V, rotation of the cover 13 and the cyclone body 1 10 in the direction A can be more facilitated. However, it is also contemplated by the present disclosure for the cyclone body 110 to be rotatably fixed to the cleaner body 11 without the cover 13.

The dust receptacle 120 is connected to a lower part of the cyclone body 110 to store the dust separated at the cyclone body 110. The dust receptacle 120 comprises a first dust collecting chamber P1, a second dust collecting chamber P2, and a handle 121 for a user to grip when removing the dust collected therein.

The first dust collecting chamber P1 is formed in the center portion of the dust receptacle 120 to collect the dust separated by the first cyclone C1. A flow prevention member 123 is mounted on a bottom of the dust collecting chamber P1 to restrain movement of the collected dust.

The second dust collecting chamber P2 is formed around the first dust collecting chamber P1 to collect the dust separated by the second cyclones C2. The number of the second dust collecting chambers P2 corresponds to the number of the second cyclones C2.

According to the above structure, relatively large dust included in the air, which is passed through the extension pipe (not shown), the suction pipe 11*b* and air suction path 111 and drawn through the first cyclone C1, is primarily separated by a centrifugal force and collected in the first dust collecting chamber P1. The dust collected on the bottom of the dust collecting chamber P1 is prevented from exiting the first dust collection chamber P1 by the flow prevention member 123 and from flowing back by the skirt 130a. The primarily-centrifuged air, after passing through the grill member 130, the air discharge path 113 and the induction cover 114, is drawn into the cone member 116 of the second cyclone C2. Relatively small dust is separated by a centrifugal force at the cone member 116 and collected in the second dust collecting chamber P2. Then, the air flows out from the cyclone body 110, passed through the discharge pipe 118 and the discharge cover 119, and is discharged to the outside of the cleaner body 11, passed through the connection pipe 11*c* in connection with the discharge cover 119, the discharge filter 140 and the vacuum source 150.

Figure 3:
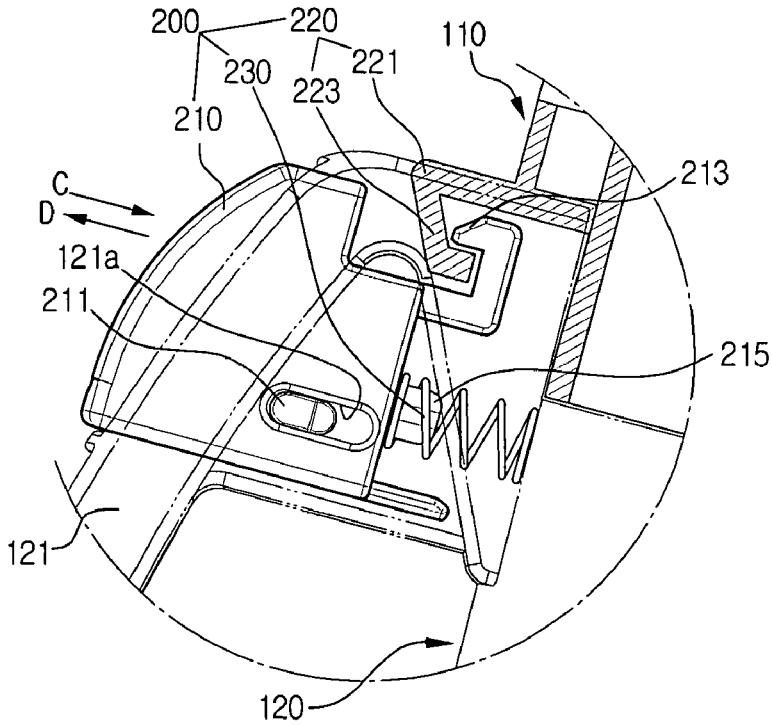
FIG. 3 is an enlarged sectional view of a locking unit of FIG. 1.

Referring to FIG. 3, a locking unit 200 locks and releases the dust receptacle 120 with respect to the cyclone body 110. To this end, the locking unit 200 comprises a button 210, a fastening part 220, and a first resilient member 230.

The button 210 is mounted to the handle 121 of the dust receptacle 120 to move in arrowed directions C and D. Guide projections 211 are formed on opposite sides of the button 210, whereas guide grooves 121a for insertion of the guide projections 211 are formed on opposite sides of the handle 121. Additionally, a hook 213 is provided to an end of the button 210 to be fastened or released to the fastening part 220.

The fastening part 220 is formed at the cyclone body 110 to correspond to the hook 213. The fastening part 220 comprises a supporting projection 221 protruded on the cyclone body 110 and a hook holder 223 disposed at a lower part of the supporting projection 221 so that the hook holder can be directly locked or released to the hook 213. The fastening part 220 may be formed integrally with the cyclone body 110 or formed as a separate part to be welded or attached onto the cyclone body 110.

The resilient member 230 is interposed between the button 210 and the dust receptacle 120 and constantly biases the button 210 in the direction D, which is a locking direction. A resilient-member insertion projection 215 is formed at the button 210 to mount the resilient member 230 to the button. One side of the resilient member 230 is fit around the resilient-member insertion projection 215. The first resilient member 230 is shown, by way of example as a coil spring. Of course, it is contemplated by the present disclosure for resilient member 230 to be any other material instead of the coil spring as long as it has sufficient resiliency to bias the button 210 in direction D. By existence of the first resilient member 230, if the button 210 is not pressed in an arrowed direction C, the button 210 can be kept in a locking position where the hook 213 and the hook holder 223 are fastened with each other, as shown in FIG. 3.

Using the locking unit 200, therefore, only the dust receptacle 120 instead of the whole of the cyclone dust collecting apparatus 100 can be drawn from the cleaner body 11. As a result, the user can facilely remove the dust collected in the dust receptacle. Also, because a special force is not required in releasing the dust receptacle 120 from the cyclone body 110, the dust does not easily bounce out from the dust receptacle 120 due to the force and contaminate the user's hand.

Hereinbelow, the process for separating the dust receptacle 120 from the cleaner body 11 will be described.

Figure 4:
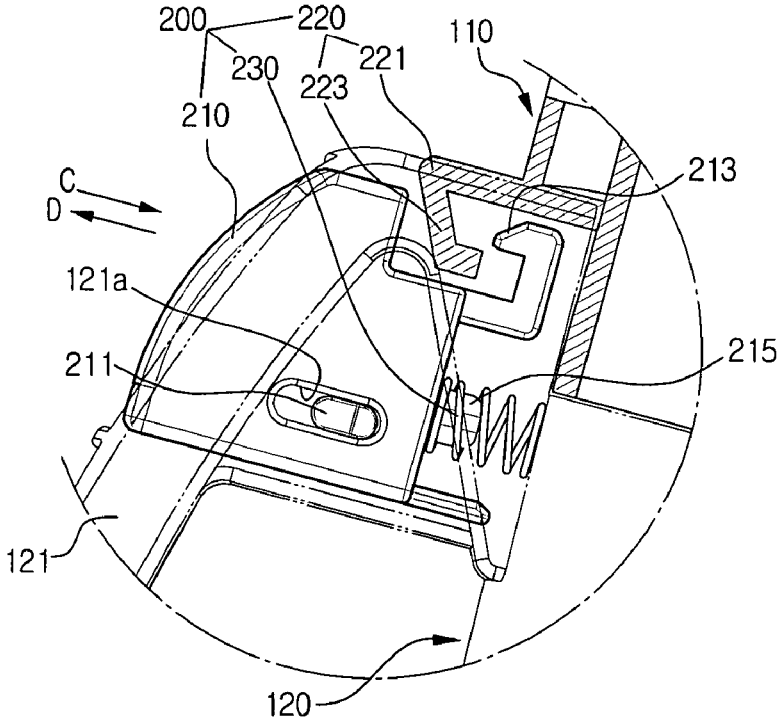
FIG. 4 shows a button of the locking unit of FIG. 3, as being pressed.

Referring to FIG. 4, as the user presses the button 210 in the arrowed direction C, the hook 213 is separated from the hook holder 223, thereby releasing the cyclone body 110 from the dust receptacle 120.

Figure 5:
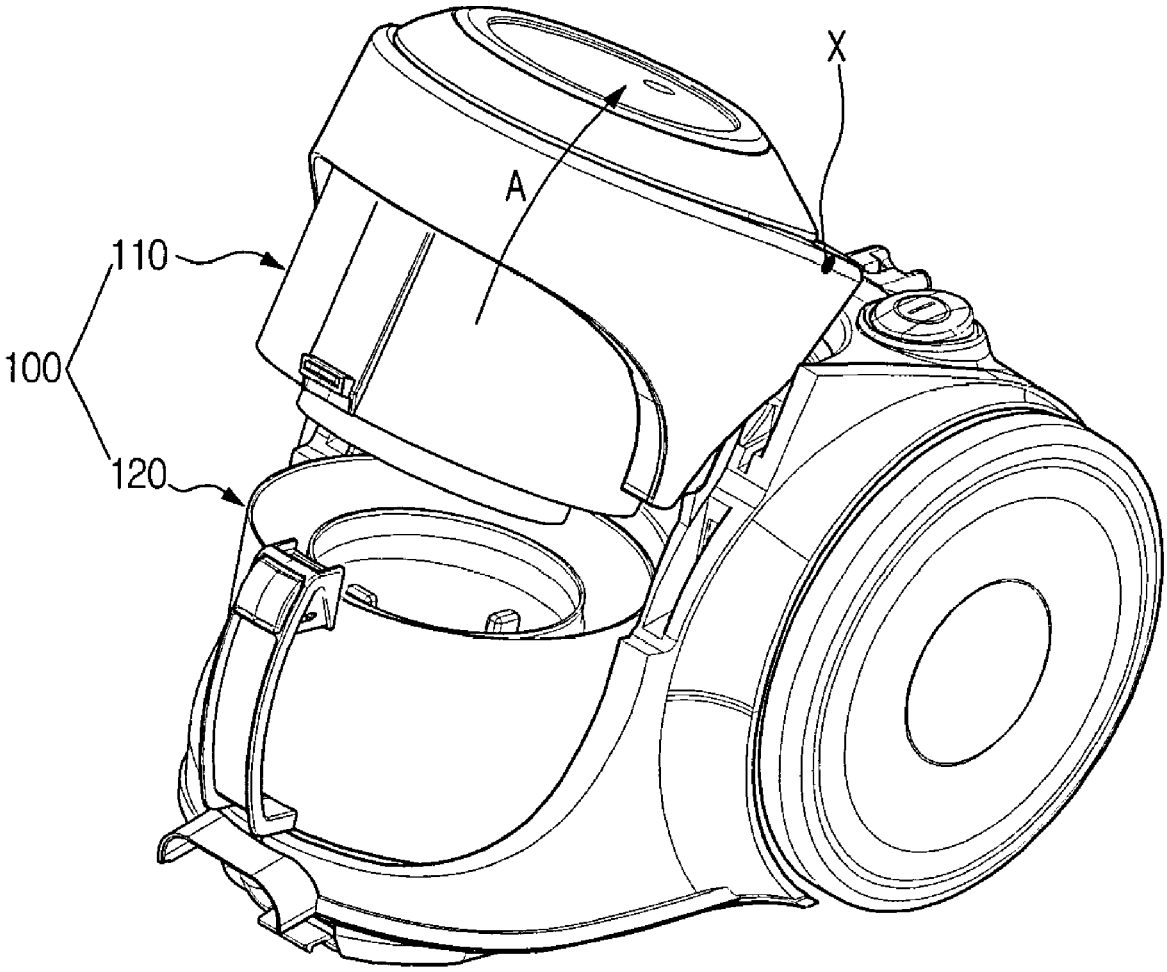
FIG. 5 shows a cyclone body of FIG. 1, as being separated from a dust receptacle of FIG. 1 and rotated.

With reference to FIG. 5, the user rotates the cyclone body 110 about the hinge shaft X in the direction A, allowing access to withdraw the dust receptacle 120 from dust collecting chamber S1 and empty the dust receptacle 120 filled with the dust.

As can be appreciated from the above description, when using a vacuum cleaner according to an embodiment of the present invention, the dust receptacle 120 can be drawn alone from the cleaner body 11 by separating the cyclone body 110 and the dust receptacle 120 from each other using the locking unit 220. Therefore, the user does not have to draw the whole cyclone dust collecting apparatus 100 and accordingly, removal of the dust collected in the dust receptacle 120 becomes easy.

Second, since the user does not have to apply a great force in separating the cyclone body 110 from the dust receptacle 120, the dust in the dust receptacle 120 is not easily bounced out by the force and therefore prevented from contaminating the user's hand.

Third, the suction pipe 11*b* is mounted on the inner bottom of the cleaner body 11 and the connection pipe 11*c* is mounted at the rear inside the cleaner body 11. In other words, since the suction pipe 11*b* and the connection pipe 11*c* are not exposed to the outside, durability thereof is improved.

Fourth, since the suction pipe 11*b* is mounted on the inner bottom of the cleaner body 11 and the connection pipe 11*c* is mounted at the rear inside the cleaner body 11, the suction pipe 11*b* and the connection pipe 11*c* do not occupy much of inner space of the cleaner body 11, thereby enabling various construction and designs of the cleaner body 11.

While the invention has been shown and described with reference to certain embodiments thereof, it will be understood by those skilled in the art that various changes in form and details may be made therein without departing from the spirit and scope of the invention as defined by the appended claims.

What is claimed is:

1. A vacuum cleaner comprising:

a cleaner body;

a cyclone body rotatably mounted in the cleaner body;

a dust receptacle detachably mounted in the cleaner body and disposed below the cyclone body; and a locking unit locking and releasing the cyclone body and the dust receptacle with respect to each other, wherein the locking unit comprises:

a button formed on a handle of the dust receptacle and having a hook;

a fastening part provided to the cyclone body to lock and release the hook; and a resilient member pressing the button in a direction for locking the hook.

2. The vacuum cleaner of claim 1, further comprising a cover rotatably mounted to the cleaner body, wherein the cyclone body is connected to the cover.

3. The vacuum cleaner of claim 2, wherein the cleaner body comprises:

a suction pipe through which the air flows into the cyclone body; and a connection pipe through which the air flows out from the cyclone body, and the suction pipe and the connection pipe are mounted within the cleaner body.

4. The vacuum cleaner of claim 3, wherein the suction pipe is extended from a front to a rear along an inner bottom of the cleaner body and bent upward by a predetermined angle to be connected with the cyclone body.

5. The vacuum cleaner of claim 1, wherein the fastening part comprises:

a supporting projection protruded on the cyclone body; and a hook holder formed on a lower part of the supporting projection.

6. A vacuum cleaner comprising:

a cleaner body;

a dust receptacle detachably mounted in said cleaner body;

a cyclone body moveably mounted in a position above said dust receptacle, said cyclone body being moveable from said position so that said dust receptacle can be removed from said cleaner body; and a locking unit having a locking position and a releasing position, said locking unit locking said cyclone body and said dust receptacle to each other in said locking position and releasing said cyclone body and said dust receptacle from each other in said releasing position, wherein the locking unit comprises:

a button formed on a handle of the dust receptacle and having a hook;

a fastening part provided to the cyclone body to lock and release the hook; and a resilient member pressing the button in a direction for locking the hook.

7. The vacuum cleaner of claim 6, wherein said handle is configured for a user to grip when removing said dust collected therein.

8. The vacuum cleaner of claim 6, further comprising a cover pivotally mounted to said cleaner body, and the cyclone body is mounted to said cover so that pivotal movement of said cover also moves said cyclone body from said position above said dust receptacle.

9. The vacuum cleaner of claim 6, wherein said cleaner body comprises a bottom that is sloped toward a back of said cleaner body by approximately 15 degrees with respect to a vertical line.

* * * * *